US005569150A

United States Patent [19]

Pane

[11] Patent Number: 5,569,150

[45] Date of Patent: Oct. 29, 1996

[54] ASSEMBLY APPARATUS

[75] Inventor: Sharon G. Pane, Rochester, N.Y.

[73] Assignee: Xerox Corporation, Stamford, Conn.

[21] Appl. No.: 345,034

[22] Filed: Nov. 25, 1994

[51] Int. Cl.[6] ..... B42F 7/02

[52] U.S. Cl. ..... 493/480; 493/379; 493/383

[58] Field of Search ..... 493/947, 344, 493/379, 468, 210, 84, 114, 115, 116, 383, 480, 468; 281/29, 31, 34, 35, 36, 37; 206/425; 229/67.1, 67.2, 67.3, 67.4

[56] References Cited

U.S. PATENT DOCUMENTS

| | | | |
|---|---|---|---|
| 2,060,906 | 11/1936 | Snyder | 493/383 |
| 3,929,059 | 12/1975 | Gendron | 493/468 |
| 4,549,878 | 10/1985 | Herrin et al. | 493/379 |
| 4,710,084 | 12/1987 | Ludvigsen | 412/9 |
| 5,025,978 | 6/1991 | Pacione | 229/67.1 |
| 5,141,485 | 8/1992 | Welt | 493/947 |
| 5,191,692 | 3/1993 | Pacione | 29/423 |
| 5,350,061 | 9/1994 | Gunn | 206/425 |

FOREIGN PATENT DOCUMENTS 0052018 5/1982 European Pat. Off. .

*Primary Examiner*—Jack W. Lavinder
*Assistant Examiner*—Darren Ark
*Attorney, Agent, or Firm*—Lloyd F. Bean, II

[57] ABSTRACT

An assembly apparatus for assembling a folder having a front panel hinged to a rear panel. Registration edges are provided for registering the front panel. Flap portion is provided for holding the front panel in a registration position. And registration edges are provided for registering the rear panel so that the rear panel is aligned when attached to the front panel being in the registration position.

1 Claim, 4 Drawing Sheets

ASSEMBLY APPARATUS

BACKGROUND OF THE INVENTION

This invention relates to paperboard folders and, more particularly, to an assembly apparatus for assembly of a folder having a front panel hinged to a rear panel with a pocket formed on the rear panel.

Many folders are known which have a one-piece construction formed to have a front panel, a rear panel and a pocket at a lower front portion of the rear panel. Such portfolio folders are useful as, for example, to contain information and promotional materials which are desired to be presented to others in a pleasing, convenient format. Known folders are frequently constructed of light cardboard and bristol board.

It is desirable to provide printed material on the exterior of the front and/or rear panels. Previously known one-piece file folders have a major disadvantage that to print material on the one-piece paperboard blank to form the folder requires both die cutting equipment and a printing press of substantial size. This requires increased costs and, in particular, substantial costs for the plates to print the large one-piece blank. Such prior art one-piece folders are, therefore, expensive to print except when printing large quantities.

A two-piece kit for a portfolio folder which is readily adapted to be purchased by a small photocopy or printing center are known U.S. Pat. No. : 5,025,978 to Pacione (also know as a DocuPac) which is hereby incorporated by reference. A front panel of the kit is sized to become comparable to that of normal papersizes and readily adapted to have printed material applied to at least one side thereof by use of standard sized photographic or offset printing equipment. After application of indicia or printed matter to the front panel, the components of the kit are then assembled by securing the front panel to the rear panel. This permits small quantities of folders to be provided with customized printing on the front panel at relatively low cost.

It has been found difficult, awkward and time consuming to assemble these two-piece kit by hand. Many two-piece kits which are assembled by hand have the front panel and the rear panel misaligned which result in misaligned folders being thrown away. Accordingly, it is highly desirable to simplify the assembly of these two-piece kits without difficulty, awkwardness or being time consuming while at the same time improving the quality and quantity of the folder produced.

SUMMARY OF THE INVENTION

In accordance with one aspect of the present invention, there is provided an apparatus for assembling a folder adapted to have a front panel hinged to a rear panel. Means are provided for registering the front panel. Means are provided for holding the front panel in a registration position. And means are provided for registering the rear panel so that the rear panel is aligned when attached to the front panel in the registration position.

Pursuant to another aspect of the present invention, there is provided an apparatus for holding and assembling a folder having a front panel hinged to a rear panel, including a bottom cover for holding a plurality of front panels and a plurality of rear panels while in a packaging mode is provided. A top cover for containing the plurality of front panels and the plurality of rear panels while in the packaging mode is provided. The top cover includes means for registering one of the plurality of front panels and means for holding one of the plurality of front panels in a registration position while in an assembly mode. The bottom cover includes second means for registering one of the plurality of rear panels so that one of the plurality of rear panels is align when attached to one of the plurality of front panels being in the registration position while in the assembly mode.

BRIEF DESCRIPTION OF THE DRAWINGS

Further aspects and advantages of the present invention will appear from the following description taken together with the accompanying drawings in which.

DETAILED DESCRIPTION OF THE DRAWINGS

Figure 1:
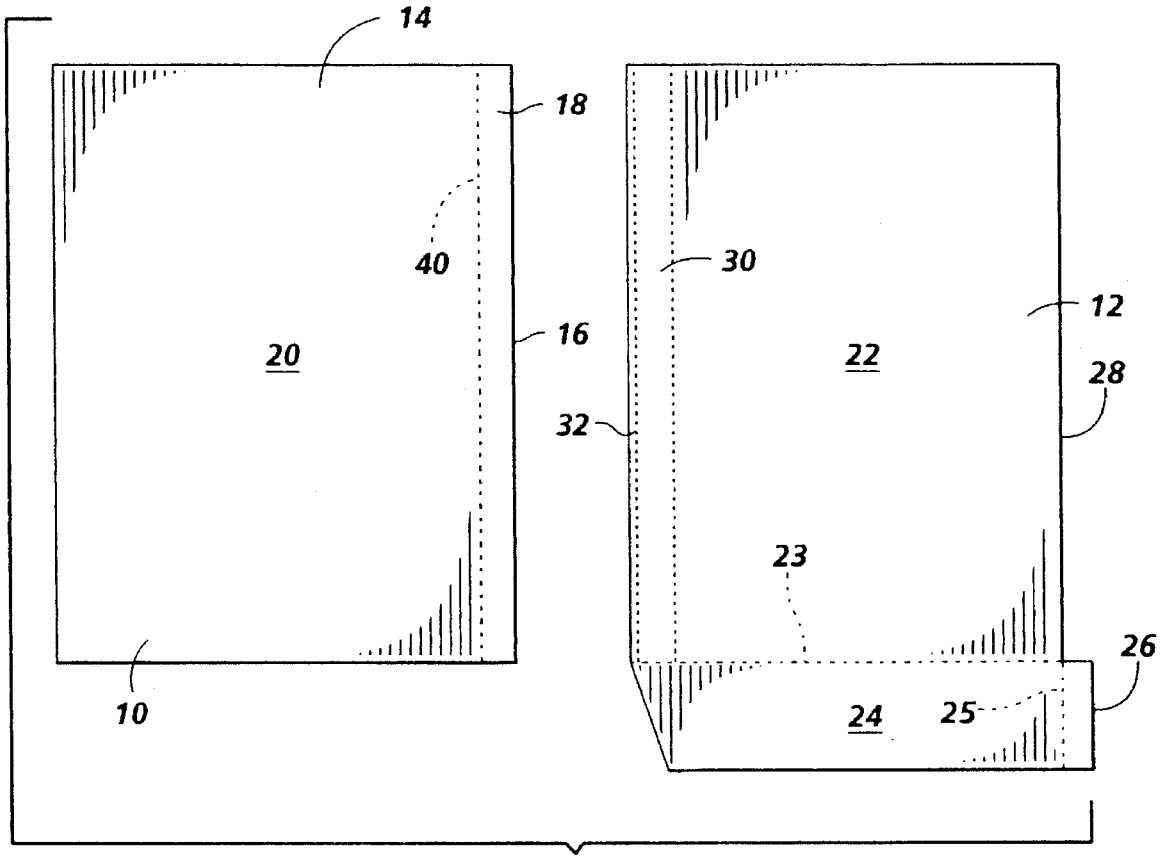
FIG. 1 is a plan view showing a front and rear panels of a kit.
Figure 2:
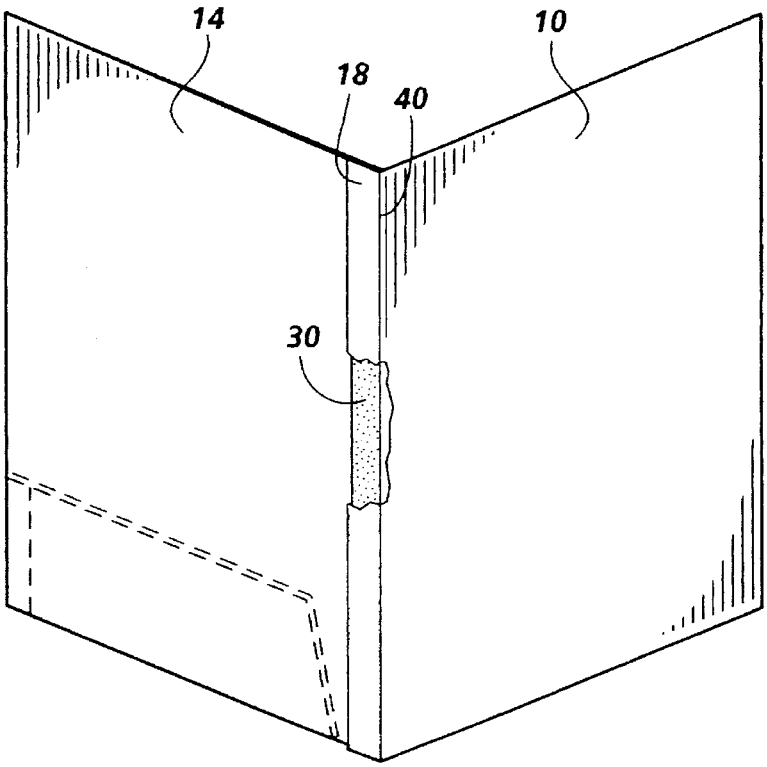
FIG. 2 shows the kit of FIG. 1 assembled.

Reference is made first to FIGS. 1 and 2 showing a kit. The kit comprises a separate front panel 10 and a separate rear panel 12. Front panel 10 comprises a rectangular sheet of paperboard having a hinge-forming scoreline 14 near one side edge 16 so as to define a thin elongate flap portion 18 between the scoreline 14 and the side edge 16 and a remaining rectangular portion 20 comprising the rest of the front panel other than flap portion 18.

Rear panel 12 comprises a planar sheet of paperboard of irregular shape having two scorelines 23 and 25 which serve to delineate the rear panel into a rectangular, major portion 22, pocket portion 24 and pocket flap 26. The rear panel is preassembled to form a pocket by having pocket flap 26 folded along scoreline 25 over pocket portion 24 and then pocket portion 24 folded along scoreline 23 to lie on top of the front face of major portion 22. Pocket flap 26 may be permanently secured as by adhesive to major portion 22 as along its lower side edge 28.

Rear panel 12 carries an adhesive strip generally indicated 30 on the rear surface of panel 12 adjacent its side edge 32.

Figure 3:
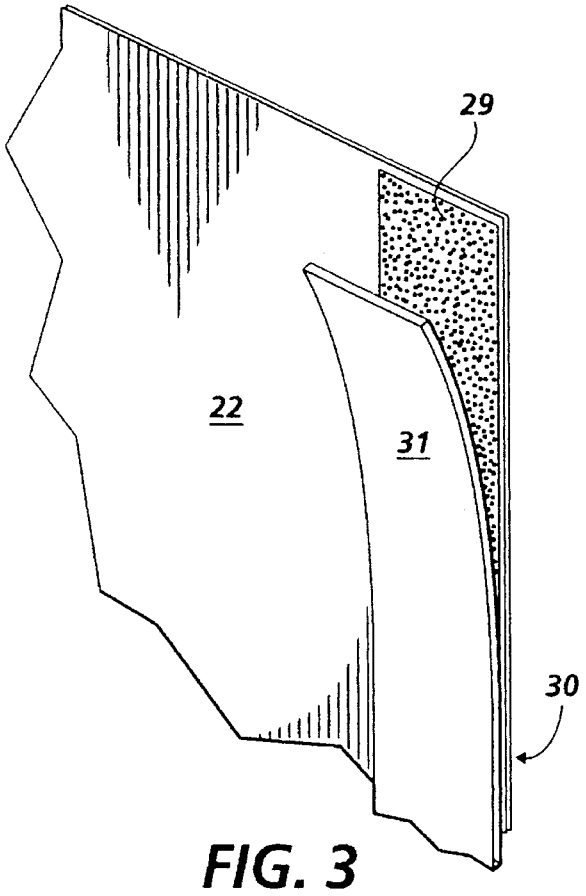
FIG. 3 shows an enlarged view of an adhesive strip of FIGS. 1 and 2.

As seen in FIG. 3, the adhesive strip 30 comprises a elongate strip of adhesive material 29 permanently secured on its undersigned to major portion 22 and having a release strip 31 covering its entire length. With the release strip 31 removed, the adhesive strip 30 is then activated and able to engage and permanently secure to flap portion 18.

As seen in FIG. 2, the front panel and rear panel of the kit of FIG. 1 have been assembled by placing the front surface of flap portion 18 of the front panel 10 over the rear of major portion 22 of rear panel 12 so that the inside surface of the flap portion 18 is engaged by the activated adhesive strip 30 thereby permanently securing the front panel to the rear panel with the scoreline 40 aligned to be parallel to the side edge 32 of rear panel 12. As assembled, the kit provides a file folder with a convenient pocket 29 into which paper sheets can be placed and then protected by the front panel folded along scoreline 14 to overlie the rear panel. As shown in FIG. 2, the flap portion 18 overlies a thin elongate side portion of said major portion 22 along side edge 32 of major portion 22 and it is to be appreciated that the adhesive strip is applied to this side portion of the rear panel.

In use of the kit of FIG. 1, the kit is preferably provided with the rear panel assembled so that the pocket as preformed. Front panel 10 comprises a thin sheet of material which may readily have printed material applied thereto. For example, the front panel 10 may be of a size and of a material composition which readily permits application of printed material as by passing the same through a conventional photocopier. Similarly, the front panel 10 may be of a size and of a composition to facilitate easy printing of the material thereon by a small-sized offset printer. Such small-sized photographic machines and small-sized offset printers are readily available in, for example, small printing houses. The front panel 10 may be preferably sized, for example, to have its rectangular portion 20 of a conventional paper size such as 8 ½ inches by 11 inches, 8 ½ inches by 14 inches and the like, with its flap port,on 18 to have a width of, for example, ½ inch. With the front panel not carrying either the adhesive strip or the pocket as seen in FIGS. 1 and 2, the front panel comprises a relatively simple flat planar sheet preferably of paperboard or bristol board which can easily be handled for printing.

The foregoing description should be sufficient to illustrate the two-piece kit for a portfolio folder to be assembled by the assembly apparatus of the present invention.

Figure 4:
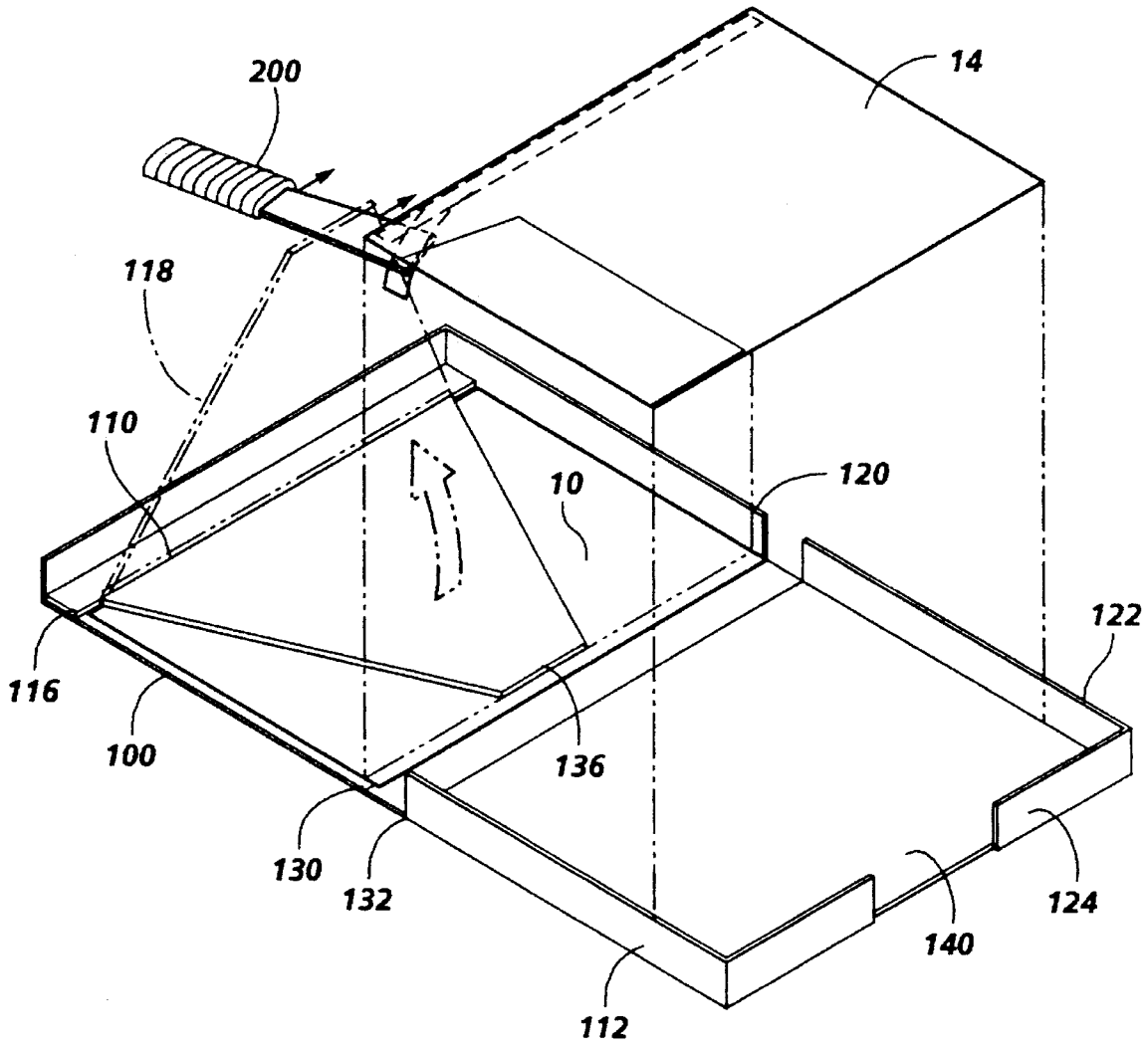
FIGS. 4 and 5 exemplary modes of operation of the assembly apparatus of the present invention.
Figure 5:
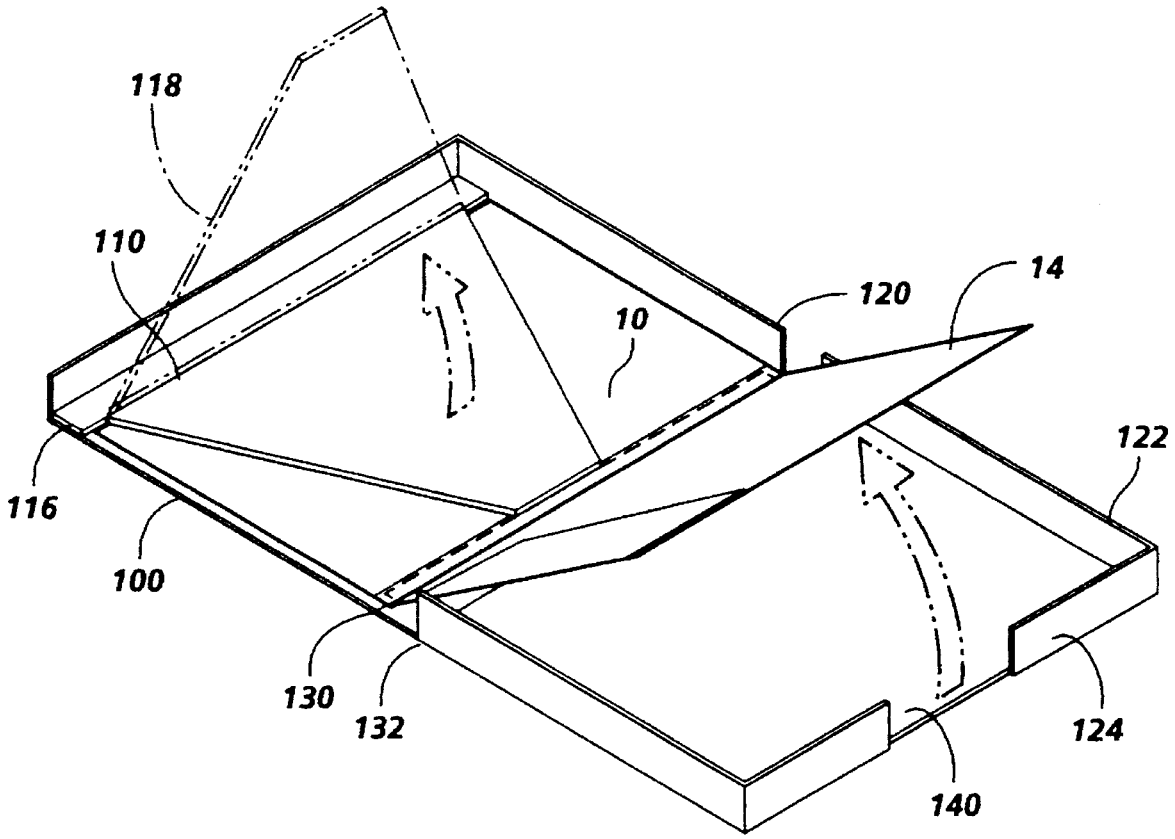

Referring to FIGS. 4 and 5, assembly apparatus and packaging device of the present invention comprises a top cover 100 and a bottom cover 112 for holding front panels and rear panels. Top cover 100 and bottom cover 112 comprises a rectangular sheet of paperboard. Top cover 100 has a hinge, near registration side edge 116, connected to elongate flap portion 118 with folding edge 136. Registration side edge 120 is positioned perpendicular to registration side edge 116. Bottom cover 112 has two registration side edges 124 and 122 which are perpendicular to each other. Between top cover 100 and bottom cover 112 there are two hinge-forming scorelines 130 and 132 which allow top cover and bottom cover to become holding packaging for holding the unassembled front panel and rear panel of the kit.

Having in mind the construction and the arrangement of the principal elements thereof, it is believed that a complete understanding of the present invention may be now had from a description of its operation. Referring to FIGS. 4 and 5:

1) assembly apparatus is opened;

2) the front panels and rear panels of the kits are removed therefrom;

3) flap portion 118 is lifted and a front panel 10 is placed under the flap portion 118 and registered on registration side edges 116 and 118.

4) flap portion 118 is closed to firmly hold the front panel 10 in place;

5) release strip 31 is removed from the rear panel 14, preferably, assembly tool 200 is used to remove release strip 31. Assembly tool 200 comprises a flexible thin metal, such as aluminum with a flexible resin coating thereon. Assembly tool has sharp edges which grips the release strip;

6) rear panel 12 is placed in the bottom cover with the side edges registered against registration side edges 120 and 122 first, then the end with the adhesive strip 30 is lowered onto front panel 10;

it should be noted that the top cover and bottom cover are dimensioned such that when the rear panel is lowered the front and rear panels are in proper alignment.

7) rear cover 12 is folded over folding edge 136 along scoreline 14 to overlie the front 10, it is also desirable to employ the flat portion of assembly tool 200 to apply force along scoreline 14 to ensure a clean fold; and 8) the completed folder is removed so that other unassembled folder can be assembled.

It is, therefore, apparent that there has been provided, in accordance with the present invention, an assembly apparatus for assembly a folder having a front panel hinged to a rear panel. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for assembling a two piece folder having a front panel hinged to a rear panel, comprising:

a first cover having at least one registration edge for registering the front panel in a registration position;

a movable flap portion, attached to said first cover, for holding the front panel in the registration position; and a second cover hinged to said first cover, said second cover having at least one registration edge for registering the rear panel so that the rear panel is aligned to the front panel when attached to the front panel in the registration position.

* * * * *